United States Patent [19]

Inoue

[11] Patent Number: 4,461,615

[45] Date of Patent: Jul. 24, 1984

[54] COMBUSTION CONTROL DEVICE

[75] Inventor: Masaharu Inoue, Numazu, Japan

[73] Assignee: Tokyo Shibaura Denki Kabushiki Kaisha, Kawasaki, Japan

[21] Appl. No.: 399,870

[22] Filed: Jul. 19, 1982

[30] Foreign Application Priority Data

Jul. 24, 1981 [JP] Japan ..... 56-109361[U]

[51] Int. Cl.[3] ..... F23N 5/00

[52] U.S. Cl. ..... 431/76; 431/25; 431/78

[58] Field of Search ..... 431/25, 59, 76, 78; 236/15 E; 340/579; 328/6

[56] References Cited

U.S. PATENT DOCUMENTS

| | | | |
|---|---|---|---|
| 2,352,143 | 6/1944 | Wills | 431/76 |
| 3,405,998 | 10/1968 | Walbridge . | |
| 3,879,667 | 4/1975 | Kraty et al. | 328/6 |
| 4,188,181 | 2/1980 | Rippelmeyer et al. . | |
| 4,396,370 | 8/1983 | Yamana et al. | 431/76 |

FOREIGN PATENT DOCUMENTS

| | | | |
|---|---|---|---|
| 989499 | 5/1976 | Canada | 431/78 |
| 1490055 | 8/1966 | France . | |
| 2081873 | 2/1982 | United Kingdom . | |

*Primary Examiner*—Carroll B. Dority, Jr.

*Attorney, Agent, or Firm*—Cushman, Darby & Cushman

[57] ABSTRACT

A combustion control device which performs combustion control based on the ambient oxygen content by using an electrode rod to be put into a flame. The combustion control device comprises an a.c. power source, a circuit connected to the a.c. power source to produce a reference voltage corresponding to a change of supply voltage, a circuit connected to the a.c. power source to detect a flame current depending on the ambient oxygen content and the supply voltage, the detecting circuit producing a detection voltage corresponding to the flame current, a circuit for comparing the detection voltage and reference voltage, and a circuit receiving an output signal from the comparing circuit to control a fuel supply valve.

4 Claims, 2 Drawing Figures

COMBUSTION CONTROL DEVICE

BACKGROUND OF THE INVENTION

This invention relates to a combustion control device using an electrode rod to be put into a flame.

Devices which perform combustion control by detecting the indoor oxygen content which depends on the condition of the flame of burner are conventionally known. One such device is disclosed in Japanese Patent Publication No. 50-28654. In combustion control, an electrode rod is first put into the flame of the burner. If an a.c. voltage is then applied between the electrode rod and the body of the burner, a d.c. current (hereinafter referred to as flame current) is produced between them by the agency of the flame. The flame current changes according to the length of the flame, which varies with the indoor oxygen content. Therefore, combustion control may be performed in accordance with the result of detection of the indoor oxygen content on the basis of the intensity of the flame current. The flame of the burner becomes longer as the indoor oxygen content is lowered. Further, the flame current is reduced as the flame is lengthened. Thus, a decrease in the flame current indicates the degree of reduction of the indoor oxygen content. The flame current of the burner is zero before the burner is ignited. The flame current takes a steady-state value while the burner is operating with a normal indoor oxygen content. If the indoor oxygen content is lowered, then the flame current decreases gradually from the steady-state value.

The flame current depends not only on the change of the indoor oxygen content, but also on the supply voltage supplied to the electrode rod. In other words, for different supply voltages a given flame current corresponds to different indoor oxygen content levels. Therefore, a change of supply voltage causes faulty operation of the combustion control device.

SUMMARY OF THE INVENTION

The object of this invention is to provide a combustion control device capable of secure combustion control despite a change of supply voltage.

In order to attain the above object, a combustion control device according to this invention is provided with a circuit for continuously changing a reference voltage to be compared with a detection voltage corresponding to a flame current according to variations of supply voltage.

The combustion control device constructed in the above manner will never faultily detect the indoor oxygen content, even though the a.c. supply voltage varies to increase or decrease the flame current.

BRIEF DESCRIPTION OF THE DRAWINGS

Other objects and advantages of the invention will become apparent from the following description taken in connection with the accompanying drawings, in which.

DETAILED DESCRIPTION OF THE PREFERRED EMBODIMENT

Figure 1:
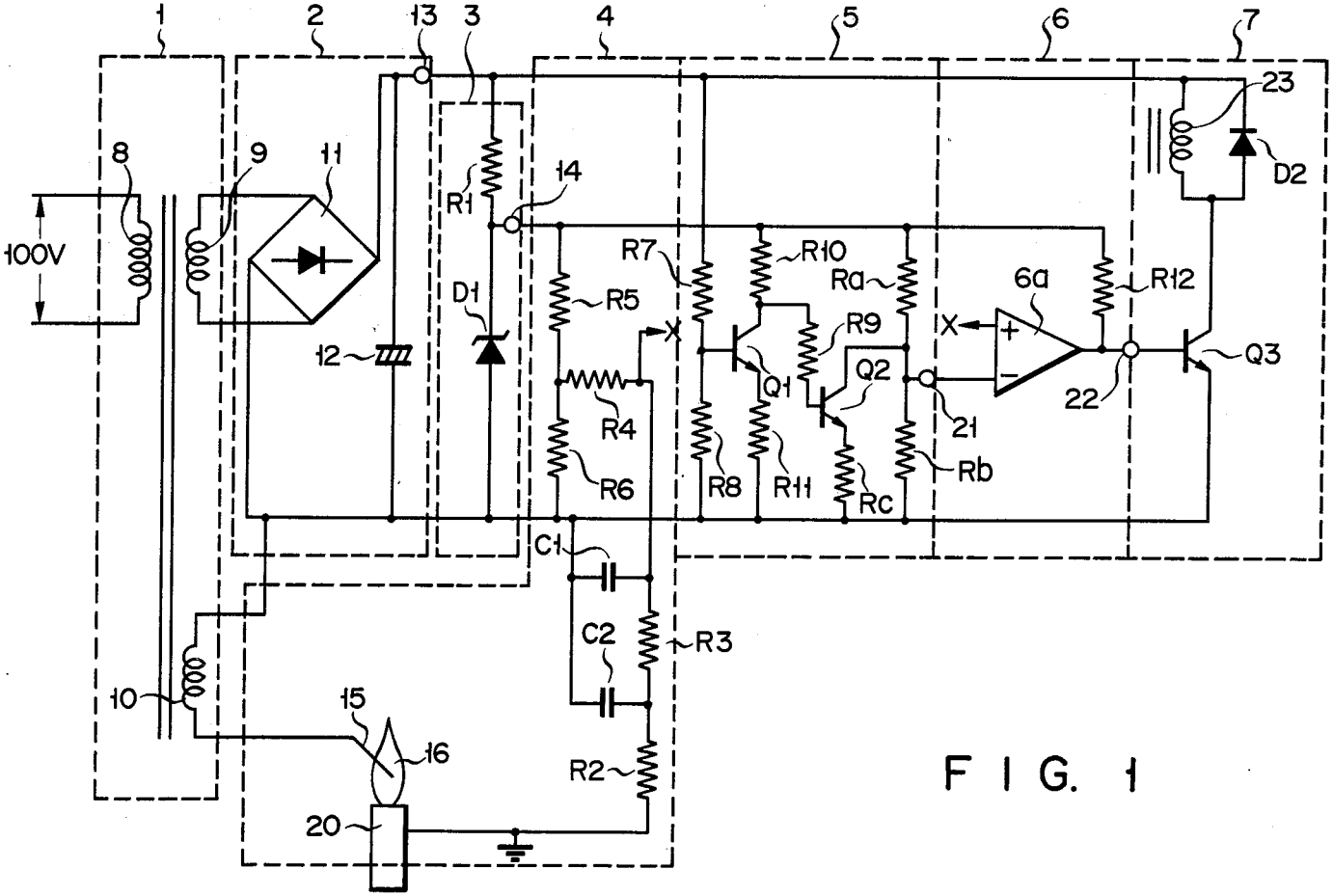
FIG. 1 is a circuit diagram of an embodiment of the combustion control device of this invention.

Referring to FIG. 1, a combustion control device according to this invention will be described. The primary side 8 of a power transformer 1 is connected to a commercial power source of 100 volts a.c. When a burner is ignited, a power switch (not shown) is turned on. The secondary side of the power transformer 1 is formed of a winding 9 for supplying a.c. current to a rectifier circuit 2 and a winding 10 for supplying a.c. current to a flame current detector circuit 4.

The rectifier circuit 2 is composed of a diode bridge 11 and a smoothing capacitor 12. The positive d.c. output terminal of the bridge circuit 11 is connected to a positive power supply terminal 13 and the smoothing capacitor 12.

A constant-current circuit 3 is composed of a resistor $R_1$ and a Zener diode $D_1$ connected in series between the positive power supply terminal 13 and the earth terminal. Positive stabilized voltage is produced from a constant-voltage terminal 14 connected to the node of the Zener diode $D_1$ and the resistor $R_1$.

The flame current detector circuit 4 is composed of an electrode rod 15 connected to the secondary winding 10 of the power transformer 1, a flame 16, a burner 20, resistors $R_1$ to $R_6$, and smoothing capacitors $C_1$ and $C_2$. Flame current flows through a series circuit of the electrode rod 15, the flame 16, the burner 20, and the resistors $R_2$, $R_3$, $R_4$ and $R_6$. A signal corresponding to the flame current is represented by a voltage X at the right end of the series-connected resistor $R_4$. The voltage signal X is supplied to the non-inverted input terminal of a comparator 6*a* in a comparator circuit 6. The level of the voltage signal X depends on the product of a flame current I and the resistance in the flame current path.

A reference level adjusting circuit 5 is provided for changing a reference level signal supplied to the inverted input terminal of the comparator 6*a* according to fluctuations of supply voltage. The reference level adjusting circuit 5 is supplied with a positive voltage source from the positive power supply terminal of the rectifier circuit 2. The voltage fluctuation level of the positive voltage source is detected by a bleeder circuit formed of resistors $R_7$ and $R_8$. The node of the series-connected resistors $R_7$ and $R_8$ is connected to the base electrode of a transistor $Q_1$. The collector of the transistor $Q_1$ is connected to the constant-voltage terminal 14 through a resistor $R_1$, and to the base of a transistor $Q_2$ through a resistor $R_9$. The emitter of the transistor $Q_1$ is grounded through a resistor $R_{11}$. Voltage fluctuations at the base electrode of the transistor $Q_1$ appear as voltage fluctuations at the collector electrode of the transistor $Q_1$.

The emitter of the transistor $Q_2$ is connected to the ground through a resistor Rc. The collector of the transistor $Q_2$ is connected to a node 21 between resistors Ra and Rb which are connected in series between the constant-voltage terminal 14 and the ground. A reference voltage Va based on the voltage fluctuation level of the 100-volt a.c. commercial power source appears at the node 21. The node 21 is connected to the inverted input terminal of the comparator 6*a*.

If the input voltage to the non-inverted input terminal of the comparator 6*a* is higher than the reference voltage Va of the inverted input terminal, an output signal from the comparator 6*a* is delivered to a solenoid valve control circuit 7. In this case, the indoor oxygen content is at a normal level. If the reference voltage Va of the inverted input terminal is higher than the input voltage to the non-inverted input terminal, on the other hand, no output signal is produced from the comparator 6a. In this case, the indoor oxygen content is at such a low level that one may suffer oxygen starvation. A resistor $R_{12}$ connected between the constant-voltage terminal 14 and the output terminal 22 of the comparator 6a is intended to cause base current to flow in a transistor $Q_3$ of the solenoid valve control circuit 7.

The solenoid valve control circuit 7 is composed of the control transistor $Q_3$, a solenoid valve relay 23, and a protective diode $D_2$. The output signal of the comparator 6 is supplied to the base electrode of the control transistor $Q_3$ through the control terminal 22. The solenoid valve relay 23 operates when the transistor $Q_3$ is turned on. Then, a solenoid valve (not shown) is opened to allow fuel to be supplied to the burner 20 through a pipe. When the relay 23 is restored, the solenoid valve is closed to cut off the fuel supply to the burner 20. When the burner 20 is cut off from the fuel supply and goes out, all the power circuits are turned off.

The operation of the combustion control device of this invention will now be described. Here let it be supposed that the voltage of the commercial power source is increased from 100 volts a.c. to, for example, 105 volts. The voltage at the positive power supply terminal 13 then rises, so that the base current of the transistor $Q_1$ is increased. Since the increase of the base current of the transistor $Q_1$ causes the voltage at one end of the load resistor $R_{10}$ to decrease, the base current of the transistor $Q_2$ is reduced. As a result, the collector-emitter resistance $R_{CE}$ of the transistor $Q_2$ is increased. Hereupon, the reference voltage Va is applied to the node 21 at a value given by $$Va = Vo \cdot \frac{Rb(R_{CE} + R_C)}{Ra + \{Rb(R_{CE} + R_C)\}} \quad (1)$$

where Vo is the voltage at the constant-voltage terminal 14. Here the symbol is used in such a manner that $R_A R_B$ represents the combined resistance of parallel-connected resistors $R_A$ and $R_B$, and may be given by $$R_A R_B = \frac{R_A \cdot R_B}{R_A + R_B},$$

for example. Therefore the increase of the collector-emitter resistance $R_{CE}$ leads to an increase of the reference voltage Va. The reference voltage Va increases as the supply voltage increases. Despite the variation of supply voltage, the range of faulty operation is greatly reduced for reasons which will be mentioned later.

Figure 2:
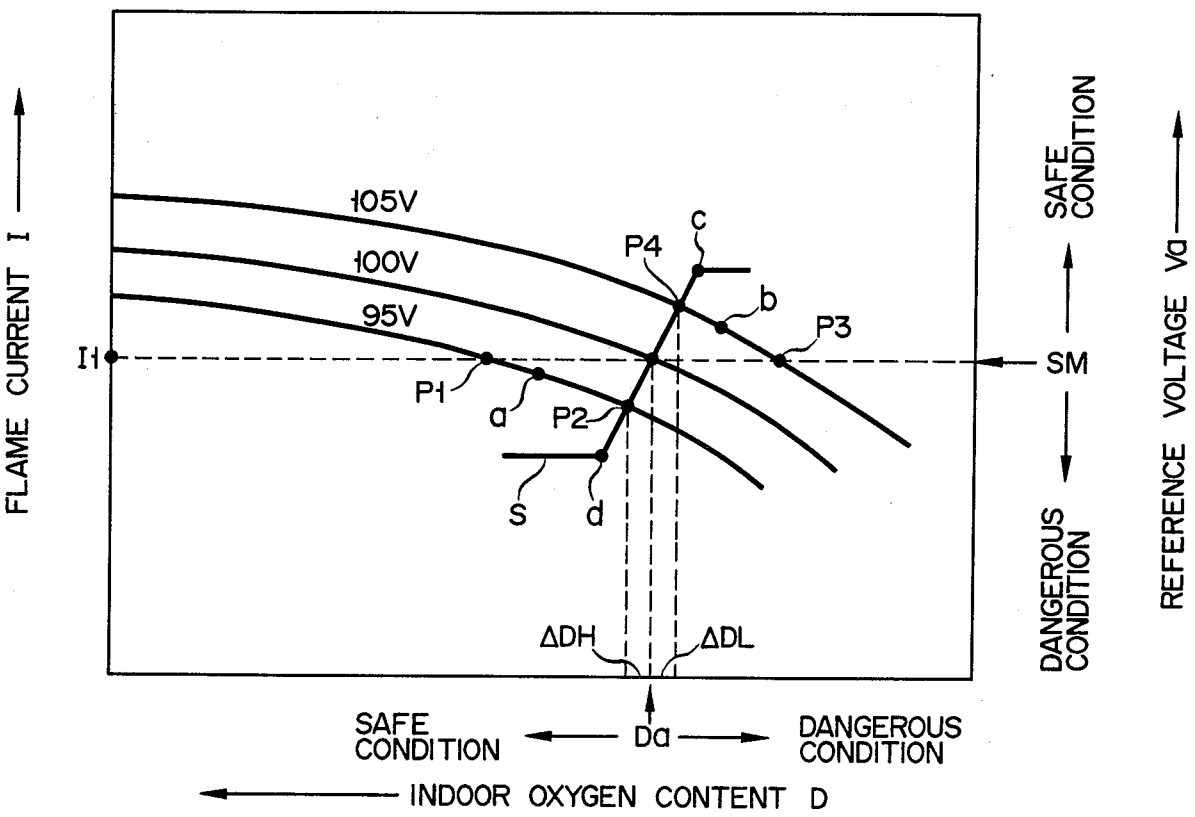
FIG. 2 is a graph for illustrating the operation of the combustion control device of the invention.

Referring now to FIG. 2, the difference between the combustion control device of the invention and the conventional one will be described. FIG. 2 is a graph showing the relationship between the indoor oxygen content D and the flame current I obtained with use of the supply voltage as a parameter. If the indoor oxygen content D increases, the flame current I also increases. In the prior art combustion control device, the indoor oxygen content D is defined as Da when the flame current I is $I_1$ regardless of the variation of the supply voltage. The indoor oxygen content Da is a critical value for the safety standard. The flame current I is converted into a voltage when it is detected. The flame current $I_1$ corresponds to a reference voltage SM. If the supply voltage reaches 95 volts, the flame current I becomes less than $I_1$ (i.e., detection voltage becomes lower than the reference voltage SM) at a point a where the oxygen content D is higher than the critical value Da. In this case, although the oxygen content D is on the side of the graph indicating a safe condition, the combustion control device stops the fuel supply because the flame current I is less than $I_1$. When the supply voltage is 95 volts, therefore, combustion control is performed with a point $P_1$ as a reference point. If the supply voltage reaches 105 volts, on the other hand, the flame current I exceeds $I_1$ (i.e., detection voltage becomes higher than the reference voltage SM) at a point b where the oxygen content D is lower than the critical value Da. In this case, although the oxygen content D is on the side indicating a dangerous condition, the combustion control device never stops the fuel supply because the flame current I is greater than $I_1$. When the supply voltage is 105 volts, therefore, the combustion control is performed with a point $P_3$ as the reference point. Thus, in the prior art combustion control device, the reference voltage SM or the flame current $I_1$ for the combustion control is fixed irrespective of the supply voltage variation.

In the combustion control device of this invention, on the other hand, combustion control is performed with points $P_2$ and $P_4$ as the reference points when the supply voltage is 95 volts and 105 volts, respectively. As represented by a curve S in FIG. 2, the reference voltage Va varies with the supply voltage variation. A point c on the curve S represents a reference voltage $Va_1$ at the node 21 obtained when the collector-emitter resistance $R_{CE}$ of the transistor $Q_2$ has a maximum. We may obtain from eq (1)

$$Va_1 = Vo \cdot \frac{Rb}{Ra + Rb}. \quad 2)$$

A point d on the curve S represents a reference voltage $Va_2$ at the node 21 obtained when the collector-emitter resistance $R_{CE}$ is zero. We may obtain from eq (1)

$$Va_2 = Vo \cdot \frac{Rb \,||\, Rc}{Ra + (Rb \,||\, Rc)}. \quad 3)$$

The greater the inclination of that section of the curve S between the points c and d, the better the control characteristic will be.

In the combustion control device of the invention, the reference point $P_1$ obtained with use of the supply voltage of 95 volts for the prior art device is shifted to the reference point $P_2$. In the condition corresponding to the point a, therefore, the fuel supply will never be cut off. Likewise, the reference point $P_3$ of the conventional case is shifted to the reference point $P_4$. In the condition corresponding to the point b, therefore, the fuel supply will certainly be cut off.

An infinitesimal increment $\Delta D_H$, to the critical value Da, of the indoor oxygen content corresponding to the point $P_2$ of the curve for the supply voltage of 95 volts is within the permitted limits. Also, an infinitesimal increment $\Delta D_L$, to the critical value Da, of the indoor oxygen content corresponding to the point $P_4$ on the curve for the supply voltage of 105 volts is within the permitted limits.

According to the combustion control device of this invention, as described above, an increase or decrease of the flame current atrributable to the variation of the a.c. supply voltage will never be faultily detected as an increase or decrease of the indoor oxygen content. Moreover, the combustion control device of the invention has an advantage in being capable of easily setting of circuit constants for various parts thereof.

What is claimed is:

1. A combustion control device for controlling combustion of a flame based on the indiret measurement of oxygen content by measuring a flame current through an electrode rod placed into said flame, comprising:

a power source;

reference voltage generating means, connected to said power source, for producing a reference voltage that is a function of supply voltage of said power source;

flame current circuit means for conducting a flame current through said flame and electrode rod;

flame current detecting means, connected to said power source and flame current circuit means for detecting flame current as a function of ambient oxygen content and the supply voltage, said flame current detecting means producing a detection voltage corresponding to the flame current;

means for comparing said detection voltage and reference voltage and generating a comparison signal indicative thereof; and means responsive to said comparison signal for controlling a fuel supply valve for controlling a supply of fuel to said flame thereby performing combustion control.

2. The combustion control device according to claim 1, wherein said power source is an a.c. power source, and said reference voltage generating means comprises means for rectifying an a.c. voltage of said a.c. power source into a d.c. voltage; means for producing a constant voltage by the use of the d.c. voltage obtained as a result of rectification; and means for forming the reference voltage by the use of said constant voltage and said d.c. voltage.

3. The combustion control device according to claim 2, wherein said reference voltage forming means comprises first and second resistors connected in series between first and second terminals of said rectifying means; a first transistor whose base is connected with a node of said first and second resistors, whose collector is connected to said first terminal through a third resistor, and whose emitter is connected to said second terminal through a fourth resistor; a second transistor whose base is connected to the collector of said first transisor through a fifth resistor and whose emitter is connected to said second terminal through a sixth resistor; and seventh and eighth resistors connected in series between said first and second terminals, the node of said seventh and eighth resistors being connected to the collector of said second transistor.

4. The combustion control device according to claim 2, wherein said flame current detecting means comprises constant voltage generating means and means for forming the detection voltage corresponding to the flame current on the basis of said constant voltage.

* * * * *